US005248477A

United States Patent [19]

Green et al.

[11] Patent Number: 5,248,477

[45] Date of Patent: Sep. 28, 1993

[54] METHODS FOR PRODUCING HIGH PURITY MAGNESIUM ALLOYS

[75] Inventors: William G. Green, Sweeny; Harvey L. King; Vladimir Petrovich, both of Lake Jackson; James E. Hillis, Angleton; William E. Mercer, II, Clute, all of Tex.

[73] Assignee: The Dow Chemical Company, Midland, Mich.

[21] Appl. No.: 964,322

[22] Filed: Oct. 21, 1992

Related U.S. Application Data

[63] Continuation-in-part of Ser. No. 758,652, Sep. 12, 1991, abandoned.

[51] Int. Cl.[5] ..... C22C 1/02

[52] U.S. Cl. ..... 420/590; 420/402

[58] Field of Search ..... 420/590, 402

[56] References Cited

U.S. PATENT DOCUMENTS

| | | | |
|---|---|---|---|
| 3,895,937 | 7/1975 | Gjosteen | 420/590 |
| 4,147,533 | 4/1979 | Flinn | 420/590 |
| 4,540,546 | 9/1985 | Giessen | 420/590 |

*Primary Examiner*—Peter D. Rosenberg

[57] ABSTRACT

A method for producing a high purity magnesium alloy is disclosed in which the alloying components are introduced in the molten state into molten magnesium. In accordance with the process of the invention, a predetermined amount of primary magnesium is heated and melted in a crucible. Predetermined amounts of desired alloying metals are selected and heated to their melting temperature in a separate crucible. The molten alloying metals are then introduced into the molten magnesium to substantially instantaneously alloy with the molten magnesium in a reaction raising the temperature of the melt. Elemental manganese when first alloyed with other alloying metals prior to its addition to the molten magnesium is found to consistently be more effective in reducing the iron impurity level of the melt to a level below 50 ppm. The introduction of a molten alloy of manganese and one or more rare earth metals into the molten magnesium, reduces a settling out of the rare earth metal from the melt and increases the alloying efficiency for the rare earth metal to greater than 80%. The efficiency of the process of the invention is substantially increased, the consumption of time and energy is decreased, and the production of magnesium chloride slag and gaseous HCl is avoided.

17 Claims, No Drawings

METHODS FOR PRODUCING HIGH PURITY MAGNESIUM ALLOYS

This application is a continuation-in-part of U.S. application Ser. No. 07/758,652 filed on Sept. 12, 1991 now abandoned.

FIELD OF THE INVENTION

This invention is directed to a process for producing high purity magnesium alloys having a low iron content.

A more particular aspect of the invention resides in a process for increasing the alloying efficiency in the manufacture of high purity magnesium alloys by introducing the alloying constituents in their molten state into a bath of molten magnesium.

A further aspect of the invention resides in an alloying process in which elemental manganese, or a mixture of elemental manganese and aluminum, is dissolved in a bath of molten metal alloying components prior to the addition of the molten alloying components to the molten magnesium. The alloying components can be added either before or after other alloying components are added to the molten magnesium. The addition of manganese as a solution to the molten magnesium effectively reduces the level of iron impurities in the melt.

It is a further object of the invention to improve the alloying efficiency for a rare earth metal or mixture of rare earth metals in magnesium alloys.

It is a further object of the invention to improve the alloying efficiency of rare earth (RE) metals, e.g. misch metal, to greater than 80%, typically greater than 90%, and routinely greater than 95% when added to molten Mg-Al-Mn alloys.

It is another object of the invention to avoid the formation of magnesium chloride and gaseous chlorine that is normally generated with the addition of manganese chloride to the melt.

The term "alloy component" or "alloying component" used herein is intended to include any of the metals that are added to the primary metal, i.e. magnesium, to form a Mg alloy with the desired properties. Primary alloying components include, for example, Al, Zn, Mn, and a RE metal or mixture of RE metals. Other metals that affect the properties of the alloy are included in the term "alloy component".

DESCRIPTION OF RELATED ART

Prior art procedures for producing alloys of magnesium (Mg) involve the introduction of solid alloying ingredients (e.g. aluminum, zinc, manganese, etc.) into a bath of molten Mg and of heating and stirring the molten metal bath until all of the solid alloying ingredients are melted and mixed into the molten Mg bath.

The quality of a Mg alloy depends on its purity. Some Mg alloy applications are more sensitive to impurities (such as oxides and flux inclusions) than others. One such application that is extremely sensitive to the presence of impurities is a Mg alloy that is used for extrusion. The reason for this is that when a billet of the alloy is extruded into a smaller shape, at high reduction ratios, it is subject to exposure of a large surface area. Impurities on or adjacent to the surface of the extruded product cause blemishes on the product surface. If these blemishes are associated with flux, i.e. any salt phase that is used to protect the metal from the atmosphere and to prevent oxidation of the Mg during foundry operation in the molten state, they can also cause accelerated corrosion rates on the surface of the extruded product. Products such as die cast parts generally have a high surface area to mass ratio and, as with extruded products, present a high probability that impurities will be exposed on the surface of the die cast parts, resulting in a corresponding probability for increased corrosion rates.

Conventional mixing of molten Mg alloys compounds these problems because of the shear inherent in such conventional mixing systems. Impeller mixers and centrifugal pumps mix by shearing the metal with rotating blades that can cause a considerable comminution of any insoluble particles, such as metal oxides and chlorides, in the melt. Thus, relatively large oxide particles which may be present in the Mg melt will be reduced to smaller and smaller particles (generally, the higher the shear, the smaller the insoluble particles). Once alloying of the molten metal is completed, the melt is normally allowed to settle for some predetermined period of time to allow the suspended impurities to settle to the bottom of the crucible as a sludge or slag. The purified alloy can then be decanted from the crucible and separated from the slag. Since high shear decreases the particle size of the impurities, the time that is required for the impurities to settle is correspondingly increased. Moreover, the efficiency and production rate is adversely affected with a corresponding increase in the cost of manufacture. In fact, the shearing action on the molten metal can be great enough to eventually emulsify the impurities in the melt, which for all practical purposes, makes a settling out of these impurities impossible. Under these conditions, the presence of the emulsified insoluble metal oxides, chlorides, or other impurities in the final product reduces the corrosion performance of the alloy or detrimentally affects the physical properties of the alloy in other ways to the point where such alloys may no longer meet their required performance characteristics.

When Mg is molten, it has a tendency to burn when exposed to air. To reduce this tendency to burn, a flux is placed on the surface of the melt. The flux, when exposed to the temperature of the molten Mg melts and forms a protective film over the surface of the molten Mg. This film shields the molten Mg from contact with air, thereby preventing oxidation and burning of the Mg. Another effective method, well known in the art, to reduce the tendency for molten Mg to burn is to use a protective gaseous atmosphere of a mixture of sulfur hexafluoride ($SF_6$). carbon dioxide ($CO_2$) and air which causes the formation of a stable oxide film on the surface of the Mg melt.

In prior art processes, it is a common procedure to add manganese chloride ($MnCl_2$) to the melt. The $MnCl_2$ reacts with the molten Mg to form insoluble magnesium chloride ($MgCl_2$) which settles as a sludge or slag to the bottom of the melting crucible. This sludge must eventually be separated from the pure alloy and disposed of. Disposal or reprocessing of the sludge is inefficient and expensive. Moreover, the use of $MnCl_2$ causes a Mg metal loss due to the formation Of $MgCl_2$ and thus further reduces the efficiency of the process and increases the cost of manufacture of the alloy. The cost of $MnCl_2$ itself is higher than the cost of elemental Mn, thus a further penalty is incurred in the use of $MnCl_2$.

In the reaction between $MnCl_2$ and Mg, gaseous hydrochloric acid (HCl) is released due to the hydrolysis of either halide, i.e. $MgCl_2$ or $MnCl_2$, with atmospheric moisture ($H_2O$), which poses another problem since the release of HCl into the atmosphere causes pollution of the environment and is not an acceptable solution. Accordingly, the recovery and safe disposal of the HCl further increases the manufacturing cost and thus reduces the efficiency of the alloying process.

In the process of making Mg alloys, it is well known to introduce Mn into the melt in order to reduce the content of Fe. Mn can be added as elemental Mn or it can be added in the form of a commercially available mixture of metals in particulate or powder form, usually in the form of a briquette, comprising about 75% Mn and about 25% Al. Presently, the elemental Mn is added to the molten Mg in the solid condition. Since there is no interaction of $MnCl_2$ with Mg to form unwanted $MgCl_2$ sludge, a melt loss in the form of $MgCl_2$ sludge does not occur. However, the addition of the elemental Mn in solid form has little effect on the reduction of Fe content in the melt.

In conventional procedures for producing a Mg alloy employing $MnCl_2$ as an Fe reducing agent, the entire alloying time that is required for settling out of the chlorides and other impurities as a sludge, i.e. to the bottom of the crucible, requires a substantial period of time, depending on the size of the batch that is being alloyed. Production of an extrusion grade Mg alloy of the type AZ31B, for example, may require further refining such as, but not limited to, flux refining, requiring additional time. The production of an extrusion grade AZ31B alloy typically includes the following steps:

1. Mg is melted in a crucible at a temperature of typically about 660° C. to 750° C.
2. Alloying constituents, e.g. Aluminum (Al) and zinc (zn) are preweighed and preheated to about 100° C. to drive off any moisture in the metals. The preheated metals are then introduced in their solid form into a basket or perforated container that is mounted so as to extend below the surface of the molten Mg in the crucible. A mixing device, such as an impeller mixer is actuated to circulate the molten Mg so that it flows through the basket to wash over the solid alloying ingredients until they have reached their respective melt temperatures or are dissolved and alloyed into the molten Mg. A drop in melt temperature is experienced during this time because of the addition of the solid metals at their lower temperature compared to the molten Mg.
3. Once the molten Al and Zn have been thoroughly mixed with the molten Mg and the melt has again reached a temperature of preferably about 720° C., anhydrous $MnCl_2$ in the form of a prill is added to the melt. As in the previous step, mixing of the melt with the impeller mixer is continued to assure proper alloying.
4. The molten alloy is then allowed to cool to a temperature of about 640° C. which is still high enough to assure that metal chlorides and other undesirable impurities, particularly iron (Fe) which forms a binary or ternary metal compound in association with Mg, Al or Mn, can settle to the bottom of the crucible. $MgCl_2$ which is formed with the addition of $MnCl_2$ to the melt is also allowed to settle to the bottom of the crucible as a sludge.
5. The molten alloy is decanted and poured into molds.
6. The sludge that has settled to the bottom of the crucible is then removed. Since the sludge still contains a valuable residue of Mg it is usually recycled.

Alloying procedures are described in "Magnesium and Magnesium Compounds", a Materials Survey by H. B. Comstock; U. S. Department of the Interior, Bureau of Mines, 1963, particularly the chapter entitled "Melting and Alloying", pp 54 to 59.

U.S. Pat. No. 4,891,065, issued Jan. 2, 1990, discloses a process for producing magnesium by contacting the magnesium melt with a combination of elemental zirconium (Zr) and elemental silicon (Si) to reduce the iron contamination, without introducing detrimental levels of reagent elements in the product Mg.

U.S. Pat. No. 4,961,783, issued Oct. 9. 1990, discloses a process for removing iron contamination from molten Mg by adding to the melt a mixture of a boron containing compound and a flux.

In "Principles of Magnesium Technology" by E. F. Emley, 1st Edition 1966, Pergamon Press, it is taught that Mn is commonly introduced into molten Mg in the form of powdered $MnCl_2$ which is shaken onto the metal surface producing the reaction $MnCl_2+Mg=MgCl_2+Mn$. On stirring the melt, some of the liberated Mn dissolves in the Mg. Alternatively, electrolytic Mn can be added directly to the molten Mg. Emley reports that a Mn alloying efficiency of from 50 to 80% is normally obtained.

SAE Technical Paper Series, International Congress & Exposition of February 24–28, 1929 W. E. Mercer II et al, contains a discussion of "The Critical Contamination Limits and Salt Water Corrosion Performance of Magnesium AE42 Alloy".

U.S. Pat. No. 4,668,170, issued Jan. 13, 1987, discloses an electromagnetic pump for circulating and stirring molten metal in a vessel. The pump is arranged in a liquid metal resistant box with a pump canal extending through the box.

SUMMARY OF THE INVENTION

It is an object of the invention to provide a method for producing Mg alloys of relatively high purity and low iron impurity content.

It is a further object of the invention to improve the alloying efficiency, increase production rates, lower manufacturing costs and avoid the release of gaseous HCl and the production of $MgCl_2$ as an undesirable by-product in the process of making high purity Mg alloys.

It is another object of the invention to provide a method for producing a high purity Mg alloy, especially alloys containing about 89% or more Mg in which the Fe impurity in the alloy is reduced to less than 50 parts per million (ppm), preferable less than 20 ppm, more preferable less than 10 ppm. An Fe impurity content of less than 10 ppm is especially desirable for extruded products.

It is a particular object of the invention to improve the alloying efficiency of the process of the invention by melting the alloying components prior to introduction of the molten alloying components into the molten Mg.

It is a further object of the invention to introduce elemental Mn per se, or a mixture of metal powders comprising elemental Mn and Al, in combination with other alloying elements in the molten state, into the molten Mg, thereby decreasing the Fe impurity in the alloy. The formation Of $MgCl_2$ slag in the melt as well as the emission of gaseous HCl, both of which are associated with present methods of introducing $MnCl_2$ into the molten Mg, is avoided.

It is another object of the invention to produce alloys of Mg and rare earth (RE) metals by introducing the RE metals, in the molten state, into the molten Mg at a substantially improved alloying efficiency. The RE metal(s) are preferably introduced into the molten Mg in combination with other alloying metals, in the molten state. The alloying efficiency for the RE metal is greater than 80%, typically greater than 90%, and more often greater than 95%, when the procedure of the invention is followed and the alloying components are added in their molten state into the molten Mg.

It is another object of the invention to prevent emulsification of insoluble impurities, e.g. oxides and chlorides in the melt by use an electromagnetic (EM) pump as a mixing device rather than as a pumping device.

Further objects and advantages of the invention will become clear to the reader from the following description of preferred embodiments.

DETAILED DESCRIPTION OF THE INVENTION

Typical procedures for manufacturing Mg alloys utilize an apparatus that includes a melting pot or crucible which is capable of holding a quantity of molten Mg, a heating means such as a gas furnace or electric coil, for heating the crucible to a point at which the Mg and other alloying ingredients are rendered molten, and a mixing apparatus such as a mechanical stirrer, air driven pump, electric pump, or the like, for mixing the alloying ingredients into the molten Mg.

Alloying of Mg is generally conducted at a temperature of from about 660° C. to about 750° C., preferably at a temperature of from about 690° C. to about 730° C. For producing the Mg alloys of the invention, a temperature of about 720° C. is most preferred. Although alloying according to the present invention can be done outside this range, temperatures below 660° C. are not conducive to good alloying efficiency with respect to the portion of the alloying ingredients that actually combine with the Mg. Temperatures above 750° C. are not necessary for good alloying efficiencies, and therefore waste the energy in heating the crucible and alloy to that high a temperature.

Mg alloys produced according to the present invention can contain a variety of metals that are generally referred to herein as alloying components, alloying constituents or alloying ingredients. These include but not limited to the more commonly used metals such as Al, Zn, Mn, Si, Zr, Ti, Be, Cu, Li, Yg Ag, Th, one or more of the RE metals of the lanthanide series, or mixtures thereof. Other metals, not specifically listed herein above can be added to the primary Mg melt to enhance the properties and/or purity of a particular alloyed product.

It is also a common practice to add the alloying components to a molten Mg bath in which the Mg is already alloyed with a desired quantity of another alloying component or components. Accordingly, it is a simple procedure in the manufacture of the alloy AE42, for example, to first melt a desired quantity of primary Mg and then prepare an alloy of Mg and a RE metal by adding a desired quantity of solid RE metal or mixtures of RE metals to the melt. Alloying is then completed by adding other alloying components, i.e. Al-MN, in the solid state to the molten MG-RE alloy.

Alloying with one or more of the rare earth (RE) metals of the lanthanide series (e.g. cerium, lanthanum, praseodymium, neodymium, etc.) is a well established technique. However, in prior art processes only about 60% of the total amount of RE metals added to a melt could be alloyed with the molten Mg. This is because RE metals preferentially reduce $MgCl_2$, and other commonly found chlorides associated with Mg melting and alloying, including $MnCl_2$, to form RE metal chlorides. The alloying efficiency with RE metals in the present invention is substantially improved, i.e. efficiencies of greater than 80%, typically greater than 90% and greater than 95% are routinely obtained.

The alloying process according to this invention can be used to produce any of a number of known Mg alloys of standard specifications such as are listed in "Annual Book of ASTM Standards" of 1988, Designations B93, B94 and B275.

Mixing of the molten metal with an impeller pump has the undesirable effect of shearing any suspended insoluble contaminants in the melt, such as metal oxides or chlorides. Intense shearing of the melt can produce emulsification of the insoluble contaminants such that they will remain in suspension for a longer period of time or, in the extreme, will not settle out and thus remain in suspension. The present invention utilizes an electromagnetic (EM) pump as a more effective mixing device without subjecting the molten metal to shearing action since the pump does not have any moving parts. Since the molten alloy is not subjected to shearing, any insoluble contaminants will retain their larger size and will therefor more readily settle to the bottom of the crucible to be separated from the melt during decanting, thereby yielding a higher purity alloy.

The EM pump is preferably supported from the cover of the crucible and is at least partially, preferably totally, submerged in the melt. When using an EM pump in accordance with the present invention, violent agitation which could break the surface of the melt is avoided. Breaking the surface of the molten metal, exposes the metal to the atmosphere thus forming undesirable metal oxides. Consequently, purer alloys are produced with the use of the EM pump. Further advantages of the EM pump are its reversibility and reduced noise level as compared to commonly used mechanical mixing devices.

In the method of the invention, one or more alloying ingredients are placed, in a solid state, in a first crucible and are brought up to the melt temperatures of the respective metals. Once the alloying components are in the molten condition, the temperature is adjusted to the melt temperature of the molten Mg and then introduced into a bath of molten Mg. Following this procedure, it has been discovered that when molten Al is added to molten Mg, a reaction occurs which raises the temperature of the melt by several degrees. The beneficial temperature increase enhances the alloying process without the need for supplying additional external heat to the molten alloy in the crucible. Alloying of the metals takes place rapidly while the metals are being mixed to achieve homogeneity. This procedure results in a high Al alloying efficiency of at least 95%, more often at least 98%.

To produce a high purity Mg alloy with a low Fe content, a purifying and settling agent for the Fe , such as Mn, Cr, Mo, Si and compounds of these elements, is traditionally used. The accepted method of alloying Mn with Mg, for example, is by the addition of anhydrous $MnCl_2$, as opposed to the simple dissolution of elemental Mn in the Mg melt, as is the case with essentially all other alloying elements. The reason for the addition of the $MnCl_2$ as opposed to the addition of elemental Mn either in pure or mixed form is that the effectiveness for Fe precipitation is significantly greater and the Mn alloying efficiency itself is significantly greater as well. It has been observed repeatedly that in primary Mg, the Mn content can be raised to a significantly higher level with $MnCl_2$ additions than can be achieved with the addition of elemental Mn in the form electrolytic flake, for example.

An explanation for this difference in the two sources of Mn suggests that elemental Mn formed in situ by the addition of $MnCl_2$, i.e.

$$MnCl_2 + Mg(metal) \rightarrow Mn(Mg\ soln) + MgCl_2$$

must be present in a phase, or compound, that is significantly different from that produced by the dissolution of elemental Mn, either as pure electrolytic flake or as a mixture of 75% Al-25% Mn.

The fact that prealloying the elemental Mn, or the Mn-Al mixture, with Al prior to its addition to a Mg melt resulted in Fe contents similar to that achieved by the addition of $MnCl_2$ in an equivalent amount suggests that the same active phase must have been generated. In contemplating the phase/compound transition that is involved here it is recognized that a hydride is involved even though Mn is not generally known to form such compounds. This is based on the fact that hydrogen is not readily measured in solid metal samples. It is know the Al has a much lower solubility for hydrogen than does Mg, and Al is known to form stable intermetallics with Mn and Fe. The phase which precipitates from the Al containing alloys of Mg has been identified as a ternary intermetallic phase consisting of varying amounts of the three elements—Al, Mn, and Fe (Hillis et al., SAE Technical Paper Series—1985, p.7). Others have tentatively identified the phase as $Al_6Mn$ or $Al_4Mn$ (Lunder & Aune, IMA 1990), however analysis by X-ray diffraction identified a sample of the ternary precipitate as $Al_5Mn_2$ with the Mn atom randomly replaced with varying amounts of Fe (Iron forms an isomorphous compound with aluminum $Al_5Fe_2$).

It is speculated that the elemental Mn addition is inactive due to the formation of a hydride phase/compound on extended exposure/storage in atmospheric humidity. When this "hydride phase" is pre-alloyed in an Al melt, the hydride is destroyed by the combination of low hydrogen solubility in Al and the formation of a relatively stable Al phase. It is this Al phase which then combines with the soluble Fe content in the Mg melt to form the less soluble Fe-Mn-Al ternary phase.

Accordingly, the addition of elemental Mn, in the solid state, to a Mg melt results in inefficient alloying of the Mn and the Fe content is poorly controlled, if at all. It has now been discovered that elemental Mn, in combination with the Al alloying element in the molten state, when added to the Mg melt effectively reduces the Fe content of Mg alloys to levels below 40 ppm as required for high purity alloys.

Rather than adding the traditional $MnCl_2$ salt to the Mg melt, which is effective for the precipitation of the Fe but which causes the formation of $MgCl_2$ and gaseous HCl, in the present invention the elemental Mn, or a mixture of elemental Mn and Al, is added in the molten state to the Mg melt instead since the $MgCl_2$ which is formed in the melt upon the addition of $MnCl_2$ is bound up in the salt and is thus not available as Mg in the alloy.

Alloying is preferably carried out in a fluxless system (without salts) in which no unwanted metal chlorides are formed. In a fluxless system, the melt is protected with a gaseous atmosphere comprising a mixture of less than about 1% $SF_6$ in about equal volumes of dry air and $CO_2$.

$MgCl_2$ will react with RE metals to form the RE chloride, thus $$2\ R.E.(metal) + 3\ MgCl_2 \rightarrow 2\ (RE)Cl_3 + 3\ Mg(metal)$$

However, when an RE metal, or a mixture of RE metals such as, for example, a "misch metal" comprising about 50% Ce, about 25% La, about 18% Nd and about 7% Pr, are added in the fluxless process with the addition of elemental Mn or a mixture of elemental Mn and Al, in the molten state, the alloying efficiency for the RE metal or metals is substantially improved to greater than 80%, more often greater than 90% and routinely greater than 95%. This is a significant advantage in both the production of virgin alloy and in recycling RE alloy scrap. Accordingly, the direct addition of elemental Mn as an alloying component in the liquid state to the liquid Mg in the alloying process of the invention produces an RE alloy with significantly higher RE alloying efficiency, low Fe impurity level and the elimination Of $MgCl_2$ from the melt.

So that the manner in which the above recited features, advantages and objects of the invention as well as others can be understood, the following examples are provided to illustrate preferred embodiments of the invention. These examples are not to be considered limiting of its scope since the invention may admit to other equally effective equivalent embodiments.

All percentages given herein are in weight percent.

EXAMPLE 1

(Not an Example of the Invention)

A magnesium alloy of the type AZ91D is prepared from a charge of 208 lbs (94.4 Kg) of primary magnesium having a purity of 99.8%. The Fe impurity in the primary Mg is at least about 350 parts per million (ppm). The primary magnesium is melted in a crucible at a temperature of 728° C. under a protective gaseous atmosphere consisting of less than about 1.0% $SF_6$ in admixture with equal amounts Of $CO_2$ and Air. The following solid alloying components are added sequentially to the Mg melt; 20.8 lbs. (9.44 Kg) of Al at the Mg melt temperature of 728° C., followed by 1.7 lbs. (0.77 Kg) of Zn at a Mg melt temperature of 717° C., and 2.9 lbs. (1.32 Kg) of anhydrous $MnCl_2$ prill at a Mg melt temperature of 715° C. The temperature of the Mg melt dropped following the addition of each solid alloying component into the melt. During the addition of the solid alloying components, the melt is stirred to enhance melting of the alloying components and to achieve homogeneity of the alloy. The alloy is then cooled to a temperature of 643° C. to allow for a gradual settling-out of metal impurities from the melt to the bottom of the crucible. An analysis of the alloy shows the following percentage amounts of metals:

| | |
|---|---|
| Al | 8.6% |
| Zn | 0.63% |
| Mn | 0.22% |
| Fe | >1 ppm |

This example illustrates that the addition of $MnCl_2$ is effective in reducing the Fe impurity in the melt. The presence of Al in the melt is also effective in reducing the Fe solubility, i.e. the higher the Al content the lower the Fe solubility, resulting in a failing out of the Fe as Fe compounds from the melt. However, the $MnCl_2$ reacted with the Mg to produce $MgCl_2$ which settled to the bottom of the crucible and which was removed as a sludge. The addition of $MnCl_2$ also resulted in an undesirable release of gaseous HCl from the melt.

The efficiency of the melt procedure was detrimentally affected in a loss of energy due to the addition of solid alloying components to the melt, i.e. at a temperature substantially less than the temperature of the Mg melt.

A cost analysis when $MnCl_2$ is used will show that only about 0.35% Mn is expended in the melt since for every pound (0.454 Kg) of added $MnCl_2$, about 0.12 pounds (54 gm. ) of Mg is lost as $MgCl_2$ sludge. Example 2 (Not an example of the invention)

Following the same general procedure as in Example 1, the alloy AZ91D is prepared without the use of $MnCl_2$. A charge of 150 lbs. (68.1 Kg) of primary magnesium is melted at a temperature of 720° C. After two minutes, a preheated charge of 15.2 lbs. (6.9 Kg) of Al and a charge of 1.4 lbs. (0.64 Kg) of Zn is added, as solid metals, to the molten Mg at a temperature of 720° C., with the mixer running. Eleven minutes later, a charge of 1.7 lbs. (0.77 Kg) of a solid Mn-Al-hardener is added to the melt at a temperature of 732° C. About 10 minutes later, the melt temperature had gone down to 724° C. The temperature of the melt is allowed to gradually decrease to 650° C. During the interval that the temperature decreased, metal impurities in the melt allowed to settle-out of the melt to concentrate at the bottom of the crucible. A sample is removed from the melt and analyzed. The analysis shows that the alloy contains the following:

| | |
|---|---|
| Al | 10% |
| Zn | 0.87% |
| Mn | 0.29% |
| Fe | 81 ppm |

This example illustrates that the addition of the Mn-Al hardener in the solid form is not effective in precipitating the Fe impurity to an acceptable level of a maximum of 40 ppm, as set as recommended in the 1988 ASTM Book of Standards. A 9% charge of Al by itself would have reduced the Fe impurity to the level achieved here.

EXAMPLE 3

(Example of the Invention)

Following the general procedure of Example 1, a charge of primary Mg of 185.3 lbs. (83.9 Kg) is placed into a 300 lb. (135.9 Kg) capacity stainless steel crucible and heated to a temperature of 721° C. at which point the Mg is in the molten state. A charge of 18.7 lbs. (8.47 Kg) of molten Al, at a temperature of 721° C., is poured into the molten Mg. An impeller mixing device is used to mix the Mg and Al together to obtain homogeneity of the alloy. The alloy melt was sampled 20 seconds later when the temperature had risen to 725° C. and at 1 minute intervals thereafter for 9 minutes.

| Al Addition (in Min.) | Al in Alloy (in %) |
|---|---|
| 0.33 | 8.7 |
| 1 | 9.0 |
| 2 | 8.9 |
| 3 | 9.1 |
| 4 | 9.2 |
| 5 | 9.0 |
| 6 | 9.2 |
| 7 | 9.0 |

The resulting data shows that complete and rapid alloying had already taken place even before the first sample was taken 20 seconds after the Al charge was added.

No heat was added externally to the crucible after the molten Al charge was introduced into the crucible. The melt temperatures taken in one minute intervals were as follows:

| Time Intervals (in Min.) | Melt Temperature |
|---|---|
| 0 | 721° C. |
| 1 | 730° C. |
| 2 | 725° C. |
| 3 | 723° C. |
| 4 | 721° C. |
| 5 | 720° C. |
| 6 | 719° C. |
| 7 | 719° C. |
| 8 | 719° C. |
| 9 | 719° C. |

This data indicates that the temperature of the melt increases the instant that the molten Al is added to the molten Mg, i.e. without the addition of externally applied heat to the melt. This phenomena is unexpected and can not presently be explained although it is surmised that the temperature increase may be due to an exothermic reaction or to a solution reaction between the Mg and the Al. A temperature increase is recorded substantially instantaneously following the addition of the molten Al to the molten Mg. The temperature reached a maximum within about 1 minute after the addition and thereafter gradually declined. As previously observed, a temperature increase does not occur when solid Al (at a substantially lower temperature) is introduced into the melt. Accordingly, the addition of molten Al to the Mg melt is highly advantageous because the unexpected increase in temperature results in a more efficient alloying procedure since no additional time or energy is needed to maintain the melt at the alloying temperature or to bring the melt back up to the desired temperature.

EXAMPLE 4

(Example of the Invention)

In the process of this invention, the following general procedure as in Example 3 is followed:

A charge of primary magnesium of 180 lbs. (81.7 Kg) is introduced into a first crucible and heated to a melt temperature of 721° C. A charge of aluminum of 18.3 lbs. (8.31 Kg) is introduced into a second crucible and heated to a melting temperature of 711° C. A charge of 1.4 lbs. (0.64 Kg) of dehydrated solid Zn, preheated to a temperature of 300° C., is added to the molten aluminum. After 10 minutes, the molten Al-ZN alloy, at a temperature of 700° C., is mixed manually with a ceramic rod and then further heated to a temperature of 721° C. The molten Al-Zn mixture (at a temperature of 721° C.) is then poured into the crucible containing the molten Mg and an impeller mixer is activated to mix the molten metals. After 3 minutes, the temperature of the alloy melt is sampled. The temperature had risen to 730° C.

This Example again illustrates that, the instant that the mixture of molten Al and Zn is added to the molten Mg, the temperature rises without the application of additional heat to the melt. The temperature increase therefor is not based on the addition af Al alone but will also occur when a combination of alloying ingredients are added, in the molten condition, to the primary Mg melt.

EXAMPLE 5

(Example of the Invention)

In accordance with the general procedure of Example 1, the alloy AZ91D is prepared without the use of $MnCl_2$. A charge of 150 lbs. (68. 1 Kg) of primary Mg is melted at a temperature of 720° C. A separate batch of metal is prepared from a charge of 15.2 lbs. (6.9 Kg) Al, 1.4 lbs. (0.64 Kg) Zn, and 1.7 lbs. (0.77 Kg) elemental Mn and melted in a separate crucible at a temperature of 710° C. The molten Al-Zn-Mn alloying component is then added to the molten Mg. A sample is taken when the temperature of the melt had decreased to 650° C. to allow for a settling-out of metal impurities from the melt. The analysis showed that the alloy contained the following:

| | |
|---|---|
| Al | 8.5% |
| Zn | 0.97% |
| Mn | 0.26% |
| Fe | 0.0006% (6 ppm) |

This example illustrates that the addition of Mn in the molten condition is effective in reducing the Fe impurities to a level that is well below the ASTM Standard of 40 ppm for the alloy AZ91D.

EXAMPLE 6

(Example of the Invention)

The previously described procedure in Example 4 is repeated with the further step of adding a mixture of elemental Mn and Al to the molten Al-Zn mixture prior to adding the entire molten Al-Zn-Mn mixture (alloying component) into the molten Mg. The Mn employed is a commercially available powder mixture of 75% Mn and 25% Al. The alloying charge is comprised of charges of 5.3 lbs. (2.41 Kg) Al, 1.8 lbs. (0.82 Kg) Zn, and 2.6 lbs. (1.18 Kg) of the elemental MN-Al powder mixture. The alloying component is heated in a separate crucible until molten.

The addition of the mixture of elemental Mn and Al to the Al-ZN mixture makes it possible to produce the alloy AZ31B having the composition specified in the 1988 Annual Book of ASTM Standards, designation B275, Table X4.1 in which the maximum permissable Fe impurity level is limited to 0.005% (50 ppm).

The molten Al/Zn/Mn alloy is then added to the molten primary magnesium containing a minimum of 350 ppm Fe. The melt is stirred until the alloying component is alloyed with the molten Mg. The melt is then allowed to cool to a temperature of 650° C. to allow for a settling-out of metal impurities from the melt. A sample is taken and analyzed. The alloy had the following composition:

| | |
|---|---|
| Mg | 96.5% |
| Al | 2.4% |
| Zn | 0.66% |
| Mn | 0.41% |
| Cu | 0.0006% (6 ppm) |
| Ni | 0.0004% (4 ppm) |
| Fe | 0.0002% (2 ppm) |

This example illustrates that the introduction of the molten alloying component, i.e. the Al-Zn-Mn mixture, into the molten Mg resulted in a substantial reduction in the Fe impurity level. The impurity levels for Cu, Ni and Fe are well within the limits of the 1988 ASTM Standards recommended for the alloy AZ31B. An analysis for Si is not made since Si is not critical to the performance of the alloy and is still within the prescribed ASTM standard. The molten alloying composition alloyed very quickly, under gentle stirrings with the molten Mg. The Mn combined with the Fe to settle out of the melt as an insoluble metal compound, resulting in the observed reduction of the Fe impurity level.

The procedure of introducing the molten Mn (in the form of the Al-elemental Mn mixture) did not generate harmful emissions of HCl. Maintenance problems associated with HCl induced corrosion of equipment and structures did not occur. A saving is realized with the method of the invention since the cost of Mn in the elemental Mn-Al mixture is less than the metallic Mn value in $MnCl_2$.

EXAMPLE 7

(Not an Example of the Invention)

In accordance with the general procedure set forth in Example 1, ingots totalling 25,520 lbs. (11,586 Kg) of the alloy AE42X1 were produced at a Casting Plant in Freeport, Texas. During the production run, the molten Mg was protected from the atmosphere by an M-130 flux having a salt composition well known in the art. Charges of Al, an Al/BE hardener, and a RE misch metal were added to the molten Mg as solid ingots. $MnCl_2$ was added to the melt.

The crucible that is used has a capacity of about 5000 lbs (2270 Kg). The total amount of alloying components used are the following:

| | |
|---|---|
| Al | 1.344 lbs. (610 Kg) |
| RE (misch metal) | 1,250 lbs. (567.5 Kg) |
| $MnCl_2$ | 474 lbs. (215.2 Kg) |
| Al/Be | 20.9 lbs. (9.5 Kg) |

An average analysis of 22 RACKS (~4 RACKS per batch of metal) gave the following results:

| | |
|---|---|
| Al | 3.95% |
| Re | 2.62% |
| Mn | 0.297% |
| Fe | 0.001% (10 ppm) |
| Be | 0.00062% (6.2 ppm) |

Based on an average analysis, the efficiencies for each metal component are as follows:

| | |
|---|---|
| Al | 86% |
| RE | 61% |
| Be | 17% |
| Mn | 42% |

This process produced an undesireable quantity of gaseous HCl. Morever, the alloying efficiencies for Al, the RE misch metal and Mn are substantially below the alloying efficiencies realized with the process of the invention.

EXAMPLE 8

(Not an Example of the Invention)

An 81 lb. (36.8 Kg) charge of primary Mg was melted in a 90 lb. (40.86 Kg) capacity crucible under an oxidation protective atmosphere of $SF_6$, $CO_2$ and air.

The following alloying constituents were prepared for subsequent addition to the molten Mg.

| | |
|---|---|
| Al | 362.2 grams |
| Al-Be Hardener | 14.5 grams (Al 95%/Be 5%) |
| Mn | 154.0 grams |
| Nd (95% purity) | 377.7 grams |

All of the alloying constituents are preheated to a minimum temperature of 100° C. prior to addition in their solid form. Utilizing a marine type impeller, the molten metal is stirred during alloying additions to achieve homogeneity of the metals in the alloy. First, the primary Mg is heated to a temperature of 760° C. The elemental Mn is added over a period of 35 minutes. The metal temperature is then lowered to 755° C. and the Al-BE hardener and Al charge are added. Two minutes later, the Nd is added to the melt and alloyed with the molten Mg over a period of 15 minutes. The temperature is reduced to 700° C. to allow for a settling-out of metal impurities from the melt and samples are taken.

Assuming a theoretical 100% alloying efficiency, the theoretical analysis of the resulting alloy is compared to the actual analysis:

| Theoretical (in %) | Actual (in %) |
|---|---|
| Al - 1.0 | Al - 0.96 |
| Nd - 0.95 | Nd - 0.99 |
| Mn - 0.70 | Mn - 0.17 |
| Be - 0.0019 | Be - 0.0010 |
| | Fe - 0.0350 |

The data indicates that the actual alloying efficiency exceeded 100% theoretical efficiency. This is probably the result of oxidation of some of the original primary Mg charge which reduced the amount of primary Mg available for alloying or it is the result of acceptable analysis error.

EXAMPLE 9

(Example of the Invention)

A charge of 279.8 lbs. (127 Kg) of primary Mg is introduced into a first crucible having a capacity of 325 lbs. (147.6 Kg) and maintained under a protective atmosphere of a mixture of $SF_6$, and equal parts of $CO_2$ and air. A charge of 13.3 lbs. (6.04 Kg) Al is introduced into a second crucible with a capacity of 25 lbs. (11.35 Kg). Both crucibles are heated to a temperature of (720° C.). The temperature of the molten Mg is increased to 752° C. at which point an impeller mixer is activated to assure melt homogeneity. Two minutes later, a charge of 8.3 lbs. (3.77 Kg) of solid RE metals, comprising 53% cerium, 23% lanthanum, 18% neodymium, 5% praseodymium, and 1% other, is added to the molten Mg at a temperature of 765° C. Fifteen minutes later, a 0.591 Kg charge of elemental MN-Al mixture (75% Mn and 25% Al) and a charge of 30 gm Al-BE hardener (95% Al; 5% Be) is introduced into the Al melt and mixed with a ceramic rod. The temperature of the Al melt is 725° C. Thirteen minutes later, the Al-Mn-Be alloy at a temperature of 710° C. is poured into the MG-RE metal alloy at a temperature of 720° C. A residual amount of 1.33 lbs. (0.6 Kg) of Al-Mn-Be remained in the crucible. The melt temperature rose to 727° C. after 1.5 minutes and is then allowed to cool gradually to a temperature of 680° C. to allow for a settling-out of metal impurities from the melt. The resulting melt is decanted and poured into molds. Samples taken from some of the resulting cast ingots had the following analysis (alloying efficiency in parenthesis):

| | |
|---|---|
| Al | 3.8% (92.0%) |
| RE | 2.72% (98.9%) |
| Mn | 0.17% (58.6%) |
| Cu | 0.0022% - 22 ppm |
| Ni | 0.0002% - 2 ppm |
| Fe | 0.0018% - 18 ppm |
| Be | 0.0005% (55.6%) |

This data indicates that the alloying efficiency for the RE metals is substantially higher compared to levels achieved with presently practiced alloying procedures, as illustrated in Example 7. The RE metals do not fall out with the Mn to reduce the alloying efficiency to a range as low as from 50 to 80% as experienced with present procedures in which the Mn is introduced into the melt in solid form or in the form of $MnCl_2$. The Fe impurity level is well within the acceptable range for high purity alloys.

In conclusion, it will be apparent to persons skilled in the art that changes can be made in the alloying procedure without departing from the spirit and the scope of this invention.

What is claimed is:

1. A method for producing a magnesium alloy without the formation of metal chlorides comprising the steps of introducing an amount of magnesium into a first crucible and heating the magnesium to a melt temperature above about 660° C., stirring the molten magnesium to obtain homogeneity of the molten magnesium or magnesium alloy, providing an oxidation protective gaseous layer over the surface of the molten magnesium, introducing an alloying component comprising aluminum and manganese into a second crucible, said manganese being elemental manganese or a mixture of elemental manganese and aluminum, and heating the alloying component to a temperature sufficient to melt the alloying component, introducing the alloying component in the molten condition into the molten magnesium thereby raising the temperature of the melt above the anticipated temperature based on the combined temperatures of the individual melts without additional heating of the melt, and mixing the molten magnesium and the molten alloying ingredient together to rapidly form the alloy.

2. The method of claim 1, wherein said alloying component is selected from metals of the group consisting of Al, Zn, Mn, Si, Zr, Ca, Be, Y, Ag, a rare earth metal of the lanthanide series, and mixtures thereof.

3. The method of claim 2, wherein said rare earth metal is a misch metal comprising a mixture of about 53% cerium, about 23% lanthanum, about 18% neodymium, about 5% praseodymium, and about 1% other metals.

4. The method of claim 1, including the step of adding at least one rare earth metal of the lanthanide series in the solid state to the molten magnesium, melting the at least one rare earth metal in the magnesium melt, and then adding said alloying component in the molten state to the molten magnesium-rare earth metal mixture.

5. The method of claim 1, including the step of cooling the magnesium alloy melt for a period of time sufficient to allow settling of insoluble impurities to the bottom of the crucible, and decanting the molten metal alloy from the crucible, said alloy containing less than 50 parts per million iron as an impurity.

6. The method of claim 5, wherein said alloy contains less than 20 parts per million iron .

7. The method of claim 5, wherein said alloy contains less than 10 parts per million iron.

8. The method of claim 1, wherein the alloying efficiency of the rare earth metal is greater than 80%.

9. The method of claim 1, wherein the alloying efficiency of the rare earth metal is at least 90%.

10. The method of claim 1, wherein no magnesium chloride is formed in the magnesium melt during alloying.

11. The method of claim 1, wherein no hydrogen chloride is formed in the magnesium melt during alloying.

12. The method of claim 1, including the step of mixing the molten magnesium and alloying component with an electromagnetic pump.

13. The method of claim 1, including the step melting a quantity of at least one rare earth metal of the lanthanide series in said second crucible, and then adding said molten alloying component to the molten magnesium.

14. A magnesium alloy produced by the method of claim 1, said alloy containing less than 50 parts per million iron as an impurity.

15. The alloy of claim 14, containing less than 10 parts per million iron as an impurity.

16. The method of claim 1, wherein said alloying component includes zinc.

17. The method of claim 1, wherein said alloying component includes at least one rare earth metal of the lanthanide series.

* * * * *